United States Patent [19]

Johnson

[11] Patent Number: 4,681,125

[45] Date of Patent: Jul. 21, 1987

[54] MOUTHPIECE FOR TOBACCO SMOKE ARTICLE

[75] Inventor: Robert R. Johnson, Louisville, Ky.

[73] Assignee: Brown & Williamson Tobacco Corporation, Louisville, Ky.

[21] Appl. No.: 708,630

[22] Filed: Mar. 6, 1985

[51] Int. Cl.[4] ..... A24D 3/04

[52] U.S. Cl. ..... 131/336; 131/339; 131/340; 131/198.1

[58] Field of Search ..... 131/336, 339–341, 131/361, 198.1

[56] References Cited

U.S. PATENT DOCUMENTS

| | | | |
|---|---|---|---|
| 3,336,928 | 8/1967 | Morehouse | 131/339 |
| 3,638,661 | 2/1972 | Pinkham | 131/339 |
| 3,910,287 | 10/1975 | Walton | 131/336 |
| 3,910,288 | 10/1975 | Hammersmith et al. | 131/339 |
| 4,256,122 | 3/1981 | Johnson | 131/336 |
| 4,362,171 | 12/1982 | Johnson et al. | 131/336 |
| 4,424,819 | 1/1984 | Silberstein et al. | 131/361 |
| 4,498,488 | 2/1985 | Johnson | 131/336 |
| 4,545,391 | 10/1985 | Johnson | 131/336 |
| 4,557,281 | 12/1985 | Litzinger, Jr. | 131/336 |
| 4,637,409 | 1/1987 | Berger | 131/198.1 |

*Primary Examiner*—Richard J. Apley
*Assistant Examiner*—H. Macey
*Attorney, Agent, or Firm*—Charles G. Lamb

[57] ABSTRACT

A tobacco smoke mouthpiece including a smoke impervious plug member having an upstream smoke inlet end and a downstream smoke outlet or mouth end with groove(s) in the periphery of the plug member extending from the inlet end to the mouth end, the plug member being blocked adjacent the inlet end so that the groove(s) forms the path for smoke flow from inlet end to mouth end of the plug member.

7 Claims, 4 Drawing Figures

MOUTHPIECE FOR TOBACCO SMOKE ARTICLE

BACKGROUND OF THE INVENTION

1. Field of the Invention

The present invention relates to tobacco smoke ventilating assemblies and, more particularly, to an improved mouthpiece plug member for a tobacco smoke article which restricts the smoke passing from the inlet end of the mouthpiece to the mouth end thereof.

2. Description of the Prior Art

In the tobacco smoking art, it is known to form tobacco smoke mouthpiece or filter units which are positioned at one end of smoking articles, such as cigarettes, the units being provided with ventilating means to introduce ambient air to the units to dilute tobacco smoke as it flows through the units, reducing smoke particulates and gas phase components delivered to the mouth of a smoker, such an arrangement being disclosed in U.S. Pat. No. 4,457,319, issued to Charles G. Lamb on July 3, 1984. A number of arrangements also are known in the tobacco smoking art which have included plug members with impervious ends to prevent smoke from passing through the body of the plug member and to divert the smoke along passages surrounding such body, such arrangements being disclosed in U.S. Pat. Nos. 3,336,928, issued to S. A. Morehouse on Aug. 22, 1967; 3,577,996, issued to Joseph H. Sherrill on May 11, 1970; 3,638,661, issued to Jesse R. Pinkham on Feb. 1, 1972; and 3,910,288, issued to Hammersmith el al on Oct. 7, 1975. However, none of these aforementioned patents teaches or suggests the novel concept of applicant's present invention which, recognizing the importance of substantially constant per puff delivery of smoke to a smoker's mouth and the proper ventilation of such delivered smoke with reduced tar content, provides a novel and improved mouthpiece for tobacco smoke which is straightforward and economical in manufacture and assembly and which, when so assembled with a tobacco rod and smoked, accomplishes such desired constant puff delivery with proper ventilation, reduced tar content and with mild and pleasing taste to a smoker throughout the smoking of the tobacco rod.

Various other features of the present invention will become obvious to one skilled in the art upon reading the disclosure set forth herein.

SUMMARY OF THE INVENTION

More particularly, the present invention provides an improved tobacco smoke article mouthpiece comprising: a smoke impervious plug member having an upstream tobacco smoke inlet end and a downstream mouth outlet end; longitudinally extending groove means along the periphery of the plug member extending from the smoke inlet end to the mouth outlet end substantially parallel the longitudinal axis of the plug member, the groove means having a smaller cross-sectional area adjacent the smoke inlet end than adjacent the mouth outlet end of the plug member; apertured tipping material enveloping the plug member with the apertures therein in communication with the groove means; the plug member being blocked adjacent the inlet end so as to be impervious to smoke flow so that the longitudinally extending groove means forms the principal passage for smoke flow from the smoke inlet end to the mouth outlet end of the plug member.

It is to be understood that various changes can be made by one skilled in the art in the arrangement, form, shape and construction of the inventive tobacco smoke mouthpiece without departing from the scope or spirit of the present invention.

BRIEF DESCRIPTION OF THE DRAWING

Referring to the drawing which discloses an advantageous embodiment of the inventive mouthpiece, a modification thereof and, certain representative performance plots thereof:

Referring to FIG. 1 of the drawing, the inventive tobacco smoke mouthpiece is disclosed in the form of a plug member 2 of generally cylindrical shape with an upstream tobacco smoke inlet end 3 and a downstream tobacco smoke outlet end 4. Plug member 2 can be formed from any one of a number of suitable materials, such as a plastic polyethylene, with the upstream tobacco smoke inlet end 3 and the downstream mouth outlet end 4 blocked so as to be impervious to smoke.

Figure 1:
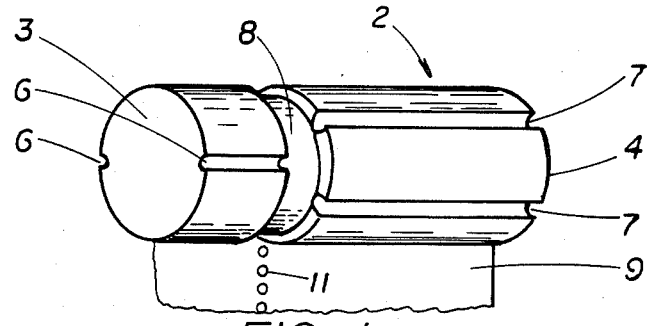
FIG. 1 is an isometric view of the inventive tobacco smoke article mouthpiece with a portion of apertured tipping material disclosed.

Disposed in plug member 2 adjacent smoke inlet end 3 thereof is a first set of longitudinally extending substantially straight grooves. As disclosed, this first set of grooves consists of a pair of opposed, spaced, substantially parallel peripheral grooves 6 longitudinally extending in the peripheral wall of plug member 2 from smoke inlet end 3 toward mouth outlet end 4, parallel the longitudinal axis of the plug member. It has been found advantageous for plug member 2 of FIG. 1 that grooves 6 have substantially uniform cross-sectional areas throughout in the range of approximately 0.13 to approximately 0.28 $mm^2$ to correspond to aerodynamic groove diameters of approximately 0.4 to approximately 0.6 mm—the cross-sectional area depending upon desired ventilation and the number of grooves—the overall diameter of plug member 2 being approximately 5 to approximately 9 mm and the overall length of plug member 2 being approximately 14 to approximately 35 mm.

A second set of grooves consisting of four equally spaced, substantially parallel peripheral grooves 7 is provided in plug member 2 toward smoke exit end 4. As disclosed, grooves 7 are offset from grooves 6 and it has been found advantageous that these grooves be approximately three to four times the length of grooves 6 with a substantially uniform cross-sectional area corresponding to aerodynamic groove diameters in the range of approximately 0.5 to approximately 1.2 mm—the cross-sectional area depending upon the ventilation, pressure drop and number of grooves 7.

An annular peripheral groove 8 is provided in plug member 2 intermediate grooves 6 and 7 to communicably connect the grooves to each other so that smoke can flow along the grooves from blocked tobacco smoke inlet end 3 to blocked mouth outlet end 4. To contain the passage of smoke within the grooves 6 and 7 and to insure proper air ventilation of the smoke as it passes from blocked smoke inlet end 3 to blocked mouth outlet end 4, a suitable tipping paper wrap 9 encloses the outer peripheral wall of plug member 2. Wrap 9 is provided with a row of spaced apertures 11, so positioned as to communicate with annular groove 8 to ventilate the smoke as it passes along groove sets 6 and 7, the principal smoke passage from blocked smoke inlet end 3 to blocked mouth outlet end 4.

Figure 2:
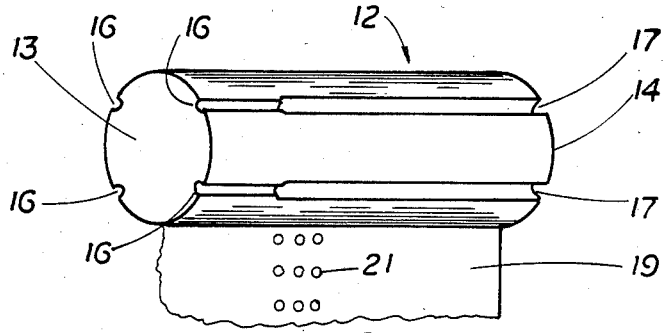
FIG. 2 is an isometric view of a modification of the inventive tobacco smoke article also with a portion of apertured tipping material disclosed.

As can be seen in FIG. 2 of the drawing, a modified inventive plug member 12 can also be provided. Such plug member 12 with blocked smoke inlet 13 and blocked mouth outlet 14 can be sized and shaped from a suitable material similar to that of plug member 2 however with groove sets 16 and 17 being connected directly to each other rather than through an annular groove 8 as are sets 6 and 7 of plug member 2. As disclosed in FIG. 2, each downstream groove 17 is connected to an upstream groove 16, four grooves being provided for each set. Advantageously, the grooves can be sized in cross-sectional area to provide aerodynamic groove diameters corresponding to grooves 6 and 7. A suitable tipping paper wrap 19 encloses the outer peripheral wall of plug member 12, wrap 19 being provided with rows of spaced apertures 21 positioned to communicate with grooves 17 to ventilate the smoke as it passes along groove sets 16 and 17, the principal smoke passage from blocked smoke inlet end 13 to blocked mouth outlet end 14. It also is to be understood that a porous plug wrap can be used to wrap the plug with an overwrap of appropriate tipping paper.

Figure 3:
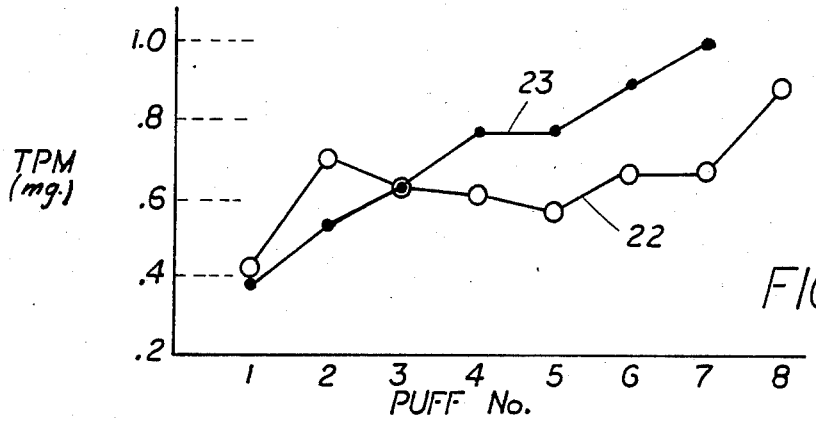
FIG. 3 is a comparative performance plot between the inventive mouthpiece and a known filter of total particulate matter (TPM) delivery on a puff-by-puff basis; and, FIG. 4 is a comparative performance plot between the inventive mouthpiece and a known filter of the percentage ventilation on a puff-by-puff basis.

Referring to FIG. 3, which compares total particulate matter delivery on a puff-by-puff basis of the inventive mouthpiece, reference numeral 22 and a known cellulose acetate tobacco filter, reference numeral 23, both cigarettes had 60–61% ventilation before lighting and both delivered 5 mg. tar. Except for the first or lighting puff and the last puff, it can be seen that the inventive mouthpiece achieved almost constant per puff delivery.

Figure 4:
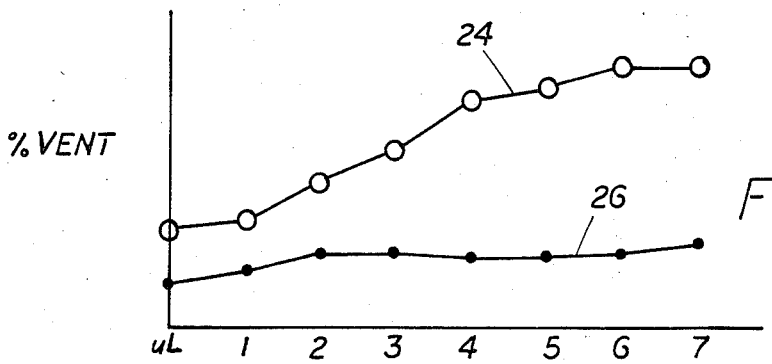

Referring to FIG. 4 which compares percentage of ventilation on a puff-by-puff basis of the inventive mouthpiece, reference numeral 24, and a known cellulose acetate tobacco filter, reference numeral 26, it can be seen that the inventive cigarette most likely achieved the aforenoted constant per puff delivery through a concomitant increase in ventilation while the cigarette was smoked. It is believed that this increased ventilation in the latter puffs of a cigarette with an inventive mouthpiece is due to blockage caused by the high velocity of smoke as it enters the tobacco smoke inlet end of smaller upstream grooves 3 (and 13) and impacts because of the higher velocity along the smaller upstream grooves to greatly increase smoke flow resistance and, accordingly, increase ventilation.

From the above, it can be seen that the inventive mouthpiece obtains desired constant puff delivery with proper ventilation and reduced tar content to provide the experienced mild and pleasing taste to a smoker.

It is to be understood that various changes can be made in the arrangement, form, groove depth and groove geometrics, without departing from the scope or spirit of the present invention.

The invention claimed is:

1. An improved tobacco smoke article comprising: a smoke impervious plug member having an upstream tobacco smoke inlet end, adjacent to a tobacco rod, and a downstream mouth outlet end; longitudinally extending groove means along the periphery of said plug member extending from said smoke inlet end to said mouth outlet end substantially parallel the longitudinal axis of said plug member, said groove means having a smaller cross-sectional area adjacent said smoke inlet end than adjacent said mouth outlet end of said plug member; apertured tipping material enveloping said plug member with the apertures therein in communication with said groove means; said plug member being blocked adjacent said inlet end so as to be impervious to smoke flow so that said longitudinally extending groove means forms the passage for smoke flow from said smoke inlet end to said mouth outlet end of said plug member.

2. The article of claim 1, said longitudinally extending groove means including a first set of spaced substantially parallel peripheral grooves longitudinally extending from said smoke inlet end of said plug member toward said mouth outlet end of said plug member and a second set of spaced substantially parallel peripheral grooves longitudinally extending from said mouth outlet end of said plug member toward said smoke inlet end of said plug member, said first and second set of grooves being communicably connected to each other intermediate said plug ends.

3. The article of claim 2, said first set of grooves having cross-sectional areas corresponding to aerodynamic groove diameters of approximately 0.4 to approximately 0.6 mm and said second set of grooves having cross-sectional areas corresponding to aerodynamic groove diameters in the range of approximately 0.5 to approximately 1.2 mm.

4. The article of claim 2, said second set of longitudinally extending grooves being approximately three to four times the length of said first set of longitudinally extending grooves.

5. The article of claim 2, and an annular peripheral groove in said plug member intermediate said inlet end and said mouth end of said plug member, said annular peripheral groove communicably connecting said first and second sets of longitudinally extending peripheral grooves.

6. The article of claim 2, said plug member having an overall length in the range of approximately 14 to approximately 35 mm.

7. An improved cigarette comprising: a generally cylindrical smoke impervious plug member having an upstream tobacco smoke inlet end, adjacent to a tobacco rod, and a downstream mouth outlet end and an overall length in the range of approximately 14 to approximately 35 mm; a first set of longitudinally extending grooves consisting of a pair of opposed spaced substantially parallel peripheral grooves longitudinally extending in the peripheral wall of said plug member from said smoke inlet end of said plug member toward said mouth outlet end of said plug member with the grooves thereof having cross-sectional areas corresponding to aerodynamic groove diameters of approximately 0.4 to approximately 0.6 mm; a second set of grooves consisting of four equally spaced substantially parallel peripheral grooves longitudinally extending in the peripheral wall of said plug member from said mouth outlet end of said plug member toward said smoke inlet end of said plug member with the grooves thereof having cross-sectional areas corresponding to aerodynamic groove diameters in the range of approximately 0.5 to approximately 1.2 mm, said second set of longitudinally extending grooves being approximately three to four times the length of said first set of longitudinally extending grooves with the grooves of said first and second sets being peripherally offset from each other; an annular peripheral groove in said plug member intermediate said first and second sets of longitudinally extending peripheral grooves to communicably connect the groove sets of said plug member; a tipping paper wrap enveloping said plug member, said tipping paper wrap having a row of spaced ventilating apertures positioned to communicate with said annular peripheral groove in said plug member; said plug member being blocked adjacent said smoke inlet and mouth outlet ends so as to be impervious to smoke flow so that said groove sets form the passage for smoke flow from said smoke inlet end to said mouth outlet end of said plug member.

* * * * *